US008643549B2

(12) United States Patent
Yamaki

(10) Patent No.: US 8,643,549 B2
(45) Date of Patent: Feb. 4, 2014

(54) MULTI-RESONANT ANTENNA

(75) Inventor: Kazuhisa Yamaki, Ishikawa-ken (JP)

(73) Assignee: Murata Manufacturing Co., Ltd., Kyoto-Fu (JP)

( * ) Notice: Subject to any disclaimer, the term of this patent is extended or adjusted under 35 U.S.C. 154(b) by 288 days.

(21) Appl. No.: 13/007,360

(22) Filed: Jan. 14, 2011

(65) Prior Publication Data

US 2011/0109513 A1 May 12, 2011

Related U.S. Application Data

(63) Continuation of application No. PCT/JP2009/057449, filed on Apr. 13, 2009.

(30) Foreign Application Priority Data

Jul. 17, 2008 (JP) ..... 2008-185508

(51) Int. Cl.
*H01Q 1/38* (2006.01)

(52) U.S. Cl.
USPC ..... 343/700 MS; 343/702

(58) Field of Classification Search
None
See application file for complete search history.

(56) References Cited

U.S. PATENT DOCUMENTS

| | | | | |
|---|---|---|---|---|
| 6,130,651 | A | 10/2000 | Yanagisawa et al. | |
| 7,236,134 | B2 * | 6/2007 | Licul et al. | 343/702 |
| 7,541,984 | B2 * | 6/2009 | Peng et al. | 343/700 MS |
| 7,619,569 | B2 * | 11/2009 | Wu et al. | 343/700 MS |
| 7,705,783 | B2 * | 4/2010 | Rao et al. | 343/700 MS |
| 2003/0052824 | A1 * | 3/2003 | Ollikainen et al. | 343/700 MS |
| 2004/0222923 | A1 * | 11/2004 | Erkocevic | 343/700 MS |

FOREIGN PATENT DOCUMENTS

| | | | |
|---|---|---|---|
| JP | 63-138710 | | 9/1988 |
| JP | 08-204431 | | 8/1996 |
| JP | 11-068453 | | 3/1999 |
| JP | 11-317612 | | 11/1999 |
| JP | 2003-258527 | A | 9/2003 |
| JP | 2004-228640 | A | 8/2004 |
| JP | 2005-303371 | A | 10/2005 |
| JP | 2006-126698 | A | 5/2006 |
| JP | 2007-036338 | A | 2/2007 |
| WO | 2007/046285 | A1 | 4/2007 |
| WO | 2007/049414 | A1 | 5/2007 |

OTHER PUBLICATIONS

International Search Report; PCT/JP2009/057449; Jul. 14, 2009.
Written Opinion of the International Searching Authority; PCT/JP2009/057449; Jul. 14, 2009.

* cited by examiner

*Primary Examiner* — Trinh Dinh
(74) *Attorney, Agent, or Firm* — Studebaker & Brackett PC

(57) ABSTRACT

A multi-resonant antenna having three independent resonance characteristics for three frequency bands includes a first electrode having an open end formed on the top surface of a dielectric substrate of a rectangular plate shape so as to extend from a feeding portion in a first direction (e.g., counterclockwise) along the periphery of the rectangular area; a second electrode having an open end and extending from the feeding portion in a second direction (e.g., clockwise) along the periphery of the rectangular area; and a third electrode positioned such that an open end of the third electrode is closer to the open end of the first electrode than to the open end of the second electrode, and such that the open end of the third electrode is closer to the open end of the first electrode than to a midsection (i.e., half the length) of the first electrode in the longitudinal direction thereof.

6 Claims, 5 Drawing Sheets

MULTI-RESONANT ANTENNA

CROSS REFERENCE TO RELATED APPLICATIONS

The present application claims priority to PCT JP2009/057449 application filed Apr. 13, 2009, and to Japanese Patent Application No. 2008-185508 filed Jul. 17, 2008. The entire contents of these references are incorporated herein by reference in their entirety.

FIELD OF THE INVENTION

The present invention relates to multi-resonant antennas available for a plurality of frequency bands suitable for mobile communications.

BACKGROUND

Japanese Unexamined Patent Application Publication No. 2003-258527 discloses an antenna for mobile communications whose bandwidth in use is increased by using a plurality of radiating conductors. Moreover, Japanese Unexamined Patent Application Publication No. 11-68453 discloses a composite antenna used in a plurality of frequency bands.

FIG. 1 is a perspective view of the antenna described in Japanese Unexamined Patent Application Publication No. 2003-258527. This antenna mainly includes a first dielectric substrate 21 and a second dielectric substrate 22. A ground electrode is formed on substantially the entire bottom surface of the first dielectric substrate 21, and a first radiating conductor 23, a second radiating conductor 24, and a third radiating conductor 25 each having an L shape are formed on either or both of the surfaces of the second dielectric substrate 22. The total length of the first radiating conductor 23 is slightly larger than an eighth-wavelength of the central frequency in the frequency band in use, and the length of the second radiating conductor 24 is slightly smaller than that of the first radiating conductor. Furthermore, the total length of the third radiating conductor 25 is substantially a quarter-wavelength of the central frequency in another frequency band in use whose frequencies are higher than those of the above-described frequency band.

FIG. 2 is a schematic view of the composite antenna described in Japanese Unexamined Patent Application Publication No. 11-68453. This composite antenna 10 includes main elements (11, 14) whose first ends serve as feeding points and sub-elements (13, 16) formed by folding back second ends of the main elements such that the feeding ends serve as open ends. The plurality of substantially U-shaped folded antennas A, B each correspond to a frequency band in use, and the main elements (11, 14) and the sub-elements (13, 16) protrude from a ground plane 3.

Since the antenna described in Japanese Unexamined Patent Application Publication No. 2003-258527 as shown in FIG. 1 has a structure in which the substrate having the radiating electrodes formed thereon is positioned upright on another substrate (i.e., motherboard), the antenna cannot be incorporated into mobile communication devices such as mobile phone units whose thickness needs to be reduced.

Moreover, although the composite antenna described in Japanese Unexamined Patent Application Publication No. 11-68453 as shown in FIG. 2 can be used in two frequency bands, the antenna is not suitable for three frequency bands. That is, even when three sub-elements are provided for the main elements by folding back the first ends of the main elements serving as the feeding points based on a similar concept, three resonance characteristics may be degraded by interference between the sub-elements. As a result, a composite antenna available for three frequency bands may not be obtained.

In view of the shortcomings of the above-discussed prior art, an embodiment of a multi-resonant antenna consistent with the claimed invention includes three independent resonance characteristics that are not degraded and the antenna is operable in three frequency bands.

In order to solve the above-described problems, a multi-resonant antenna consistent with the claimed invention has the following structure.

(1) The multi-resonant antenna includes a first electrode with an open end having a length corresponding to a first frequency band and extending from a feeding portion in a first direction along the periphery of a substantially rectangular area; a second electrode with an open end having a length corresponding to a second frequency band, the second frequency band being higher than the first frequency band, and the second electrode extending from the feeding portion in a second direction opposite to the first direction along the periphery of the substantially rectangular area; and a third electrode with an open end having a length corresponding to a third frequency band, the third frequency band being intermediate between the first and second frequency bands, and the third electrode extending from a predetermined point of the first or second electrode or from the feeding portion along the first electrode inside the substantially rectangular area surrounded by the first and second electrodes, the open end of the third electrode being closer to the open end of the first electrode than to the open end of the second electrode.

(2) The open end of the third electrode is closer to the open end of the first electrode than to a midsection in a longitudinal direction of the first electrode when viewed from the feeding portion.

According to the embodiment, the third electrode is disposed or nested inside the first and second electrodes so as to be adjacent to the first electrode, which is longer than the second electrode. According to the embodiment, the antenna can be well matched at the resonant frequency corresponding to the third electrode.

In addition, since the third electrode does not significantly affect the two resonance characteristics by the first and second electrodes, desired three resonance characteristics can be obtained.

The following description of various aspects and embodiments will further clarify the above-mentioned features and advantages.

DETAILED DESCRIPTION

A multi-resonant antenna according to a first embodiment will now be described with reference to FIGS. 3 to 6.

Figure 1:
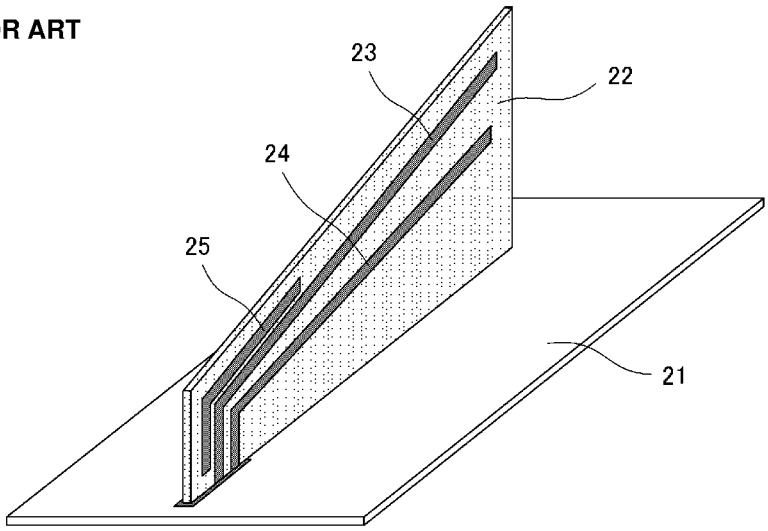
FIG. 1 PRIOR ART
FIG. 1 is a perspective view of the antenna described in Japanese Unexamined Patent Application Publication No. 2003-258527.
Figure 2:
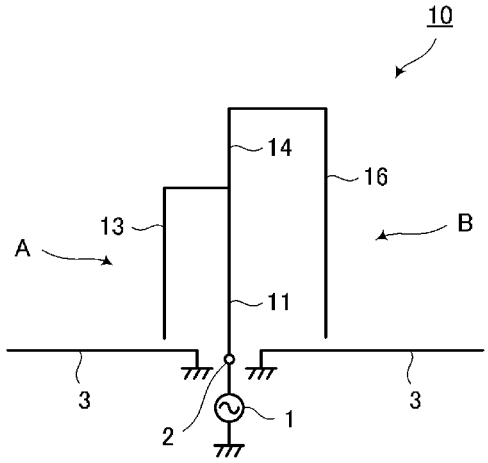
FIG. 2 PRIOR ART
FIG. 2 is a schematic view of the composite antenna described in Japanese Unexamined Patent Application Publication No. 11-68453.
Figure 3:
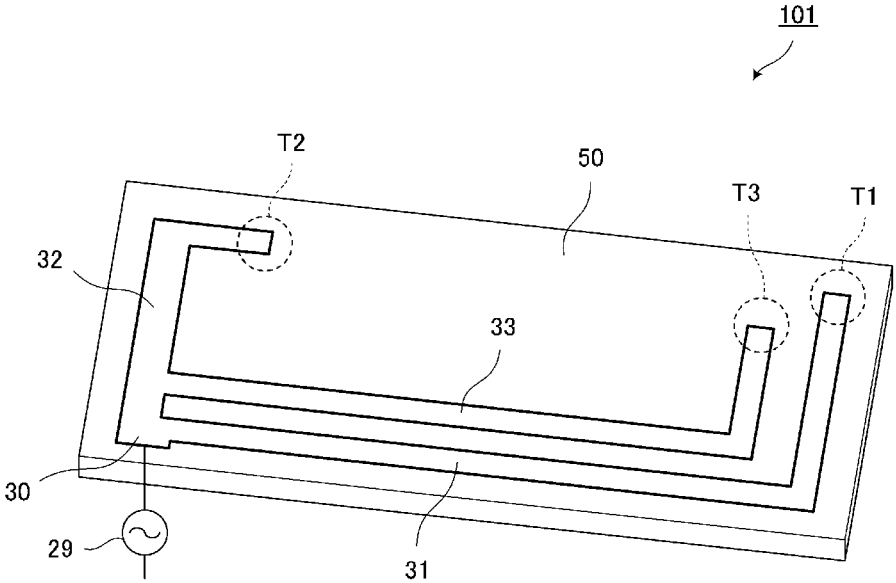
FIG. 3 is a perspective view of an electrode-pattern area of a multi-resonant antenna according to a first embodiment.

FIG. 3 is a perspective view of an electrode-pattern area of the multi-resonant antenna according to the first embodiment. A first electrode (i.e., first radiating electrode) 31, having an open end T1, is formed on the top surface of a dielectric substrate 50 having a rectangular plate shape so as to extend from a feeding portion 30 in a first direction (i.e., counter-clockwise) along the periphery of the rectangular area. In addition, a second electrode (i.e., second radiating electrode) 32, having an open end T2, extends from the feeding portion 30 in a second direction (i.e., clockwise) along the periphery of the rectangular area.

The first electrode 31 has a length corresponding to the 900 MHz frequency band serving as a first frequency band, and the second electrode 32 has a length corresponding to the 2,100 MHz frequency band serving as a second frequency band.

In addition, a third electrode (i.e., third radiating electrode) 33 having an open end T3 extends from a predetermined point of the second electrode 32 adjacent to the feeding portion 30 along the first electrode 31 inside the rectangular area surrounded by the first electrode 31 and the second electrode 32. This third electrode 33 has a length corresponding to the 1,600 MHz band serving as a third frequency band, which is intermediate between the first and second frequency band and higher than the first frequency band and lower than the second frequency band.

In addition, the third electrode 33 is positioned such that the open end T3 of the third electrode 33 is closer to the open end T1 of the first electrode 31 than to the open end T2 of the second electrode 32. Moreover, the open end T3 of the third electrode 33 is closer to the open end of the first electrode 31 than to the midsection (half the length) of the first electrode in the longitudinal direction thereof.

Figure 4:
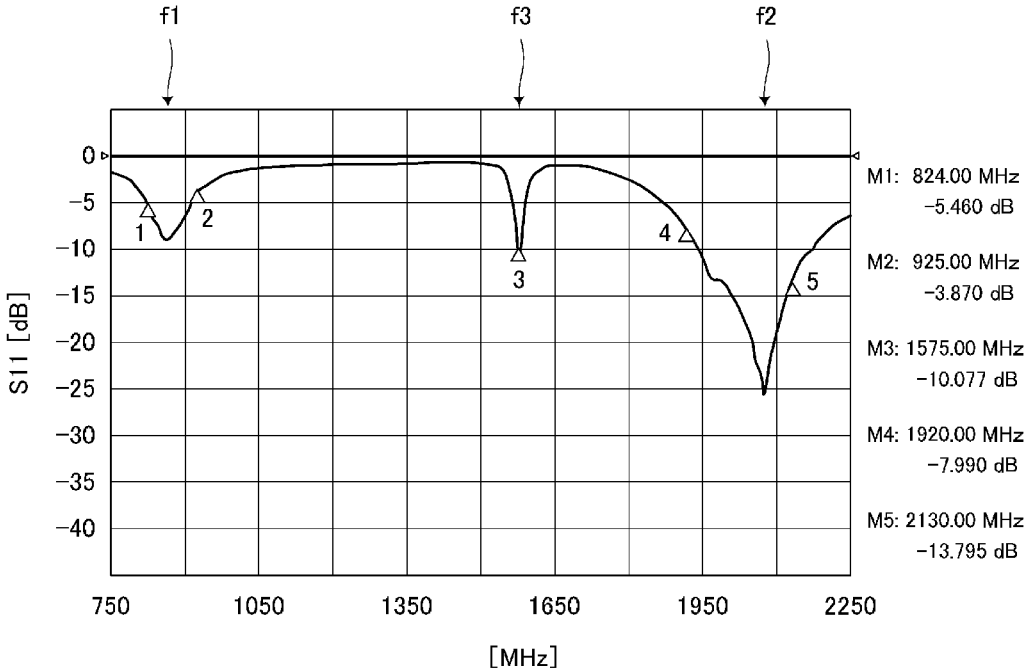
FIG. 4 illustrates a frequency characteristic of the return loss of the multi-resonant antenna 101 shown in FIG. 3.

FIG. 4 illustrates a frequency characteristic of the return loss of the multi-resonant antenna 101 shown in FIG. 3. The reduction in the return loss in the first frequency band indicated by f1 corresponds to the resonance of the first electrode 31 shown in FIG. 3, and that in the second frequency band indicated by f2 corresponds to the resonance of the second electrode 32 shown in FIG. 3. Furthermore, the reduction in the return loss in the third frequency band indicated by f3 corresponds to the resonance of the third electrode 33 shown in FIG. 3.

Figure 5:
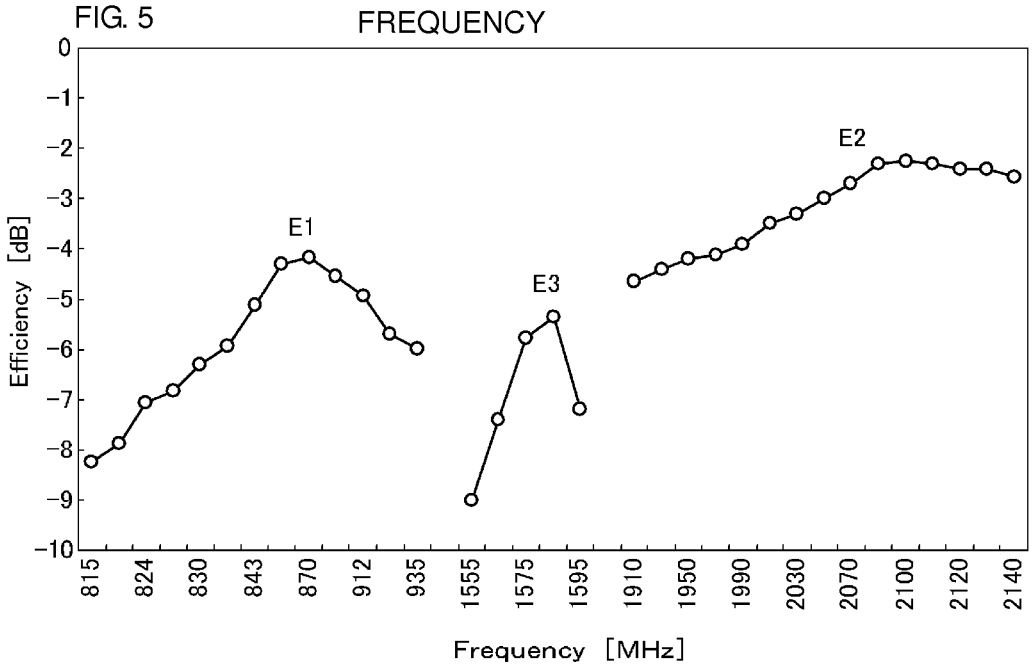
FIG. 5 illustrates a frequency characteristic of the efficiency of the multi-resonant antenna 101 shown in FIG. 3.

FIG. 5 illustrates a frequency characteristic of the efficiency of the multi-resonant antenna 101 shown in FIG. 3. Herein, a curve E1 in a frequency range of 815 to 935 MHz corresponds to the resonance of the first electrode 31 shown in FIG. 3, a curve E2 in a frequency range of 1,910 to 2,140 MHz corresponds to the resonance of the second electrode 32 shown in FIG. 3, and a curve E3 in a frequency range of 1,555 to 1,595 MHz corresponds to the resonance of the third electrode 33 shown in FIG. 3.

In this manner, the first electrode 31 that resonates at the lowest frequency and the second electrode 32 that resonates at the highest frequency among the three resonant frequencies are disposed outside in relation to the first and second electrodes 31 and 32, respectively, and the third electrode 33 that resonates at the second frequency serving as the intermediate frequency is disposed inside the first and second electrodes. At the same time, the third electrode 33 is disposed adjacent to the first electrode 31. With this, the capacitance between the third electrode and the first electrode and that between the third electrode and the second electrode can be balanced, and the antenna can be well matched, thereby degradation in the efficiency can be suppressed.

In addition, since the open end T3 of the third electrode 33 is closer to the open end T1 of the first electrode 31 than to the open end T2 of the second electrode 32, the first electrode and the third electrode can be strongly capacitively coupled. However, it is important that the open end of the third electrode and that of the first electrode be not too strongly coupled.

Figure 6:
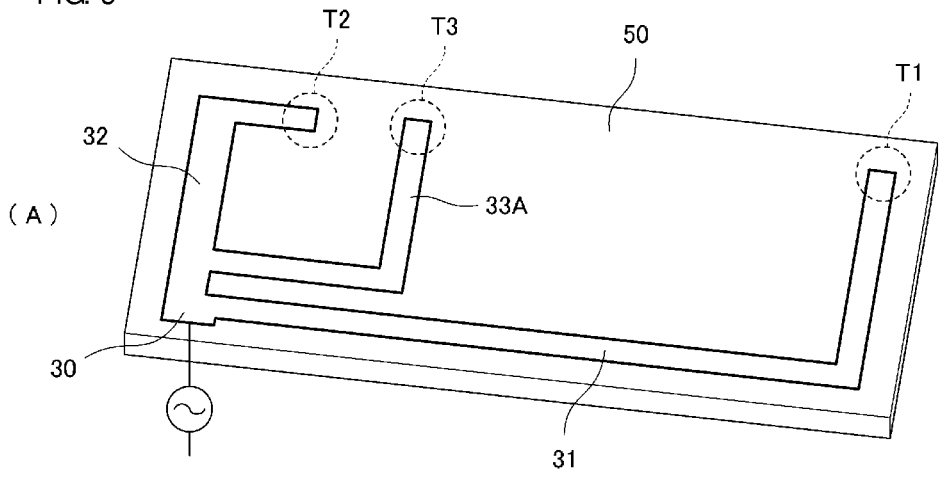
FIG. 6 illustrates the structures of two antennas serving as Comparative Examples of the multi-resonant antenna 101 according to the first embodiment.
Figure 6:
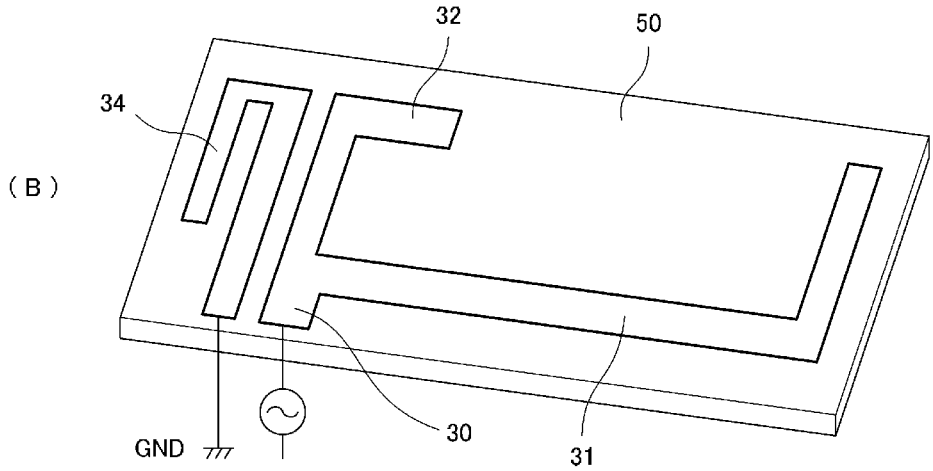

FIG. 6 illustrates the structures of two antennas serving as Comparative Examples of the multi-resonant antenna 101 according to the first embodiment.

In the example shown in FIG. 6(A), the structures of a first electrode 31 and a second electrode 32 are the same as those shown in FIG. 3. Although a third electrode 33A extends from the same position shown in FIG. 3, the electrode only partially extends along the first electrode 31, and an open end T3 thereof is located closer to an open end T2 of the second electrode 32 than to an open end T1 of the first electrode 31.

In the example shown in FIG. 6(B), although a first electrode 31 and a second electrode 32 branch from a feeding portion 30 as in the example shown in FIG. 3, another electrode 34 extends partially along the second electrode 32, and an end thereof adjacent to the feeding portion 30 is grounded.

The multi-resonant antenna having the structure shown in FIG. 6(A) cannot be matched in the third frequency band in which the third electrode 33A would resonate, and three resonance characteristics cannot be obtained.

Moreover, in the case where the electrode 34 is directly connected to the ground as shown in FIG. 6(B), the two of the feeding portion and the ground point need to be connected to an RF circuit. This increase in the number of contact points causes a problem of instability.

Figure 7:
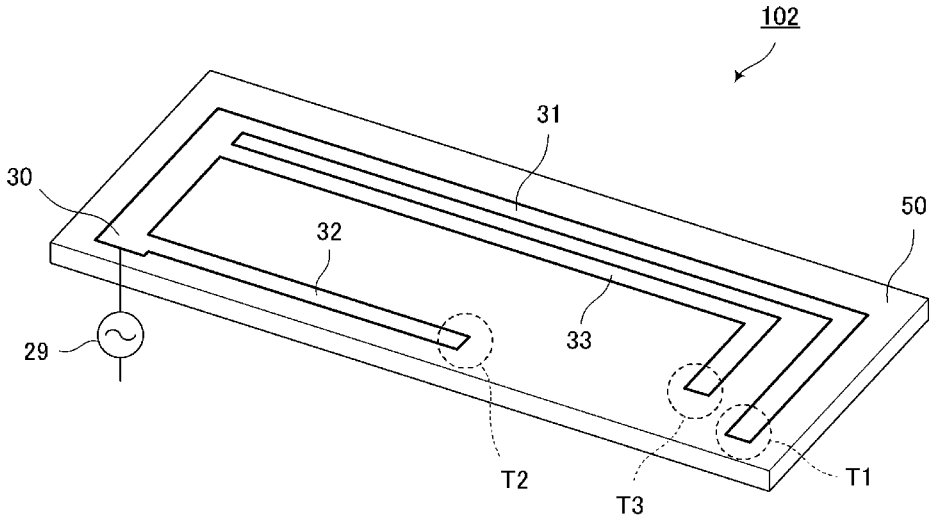
FIG. 7 is a perspective view of a multi-resonant antenna 102 according to a second embodiment.

FIG. 7 is a perspective view of a multi-resonant antenna 102 according to a second embodiment. A first electrode 31 extends from a feeding portion 30 clockwise, and a second electrode 32 linearly extends from the feeding portion 30 to the right. In addition, a third electrode 33 extends from a predetermined point of the first electrode 31 along the first electrode 31 inside the rectangular area surrounded by the first electrode 31 and the second electrode 32.

In addition, an open end T3 of the third electrode 33 is closer to an open end T1 of the first electrode 31 than to an open end T2 of the second electrode 32.

The first electrode 31 has a length corresponding to a first frequency band, and the second electrode 32 has a length corresponding to a second frequency band. Moreover, the third electrode 33 has a length corresponding to a third frequency band.

Even when the third electrode 33 branches from a predetermined point of the first electrode 31 in this manner, three resonance characteristics can be obtained as in the first embodiment.

The third electrode 33 can directly extend from the feeding portion 30, instead of branching from a predetermined point of the first electrode 31 as shown in FIG. 7, or instead of branching from a predetermined point of the second electrode 32 as shown in FIG. 3.

Figure 8:
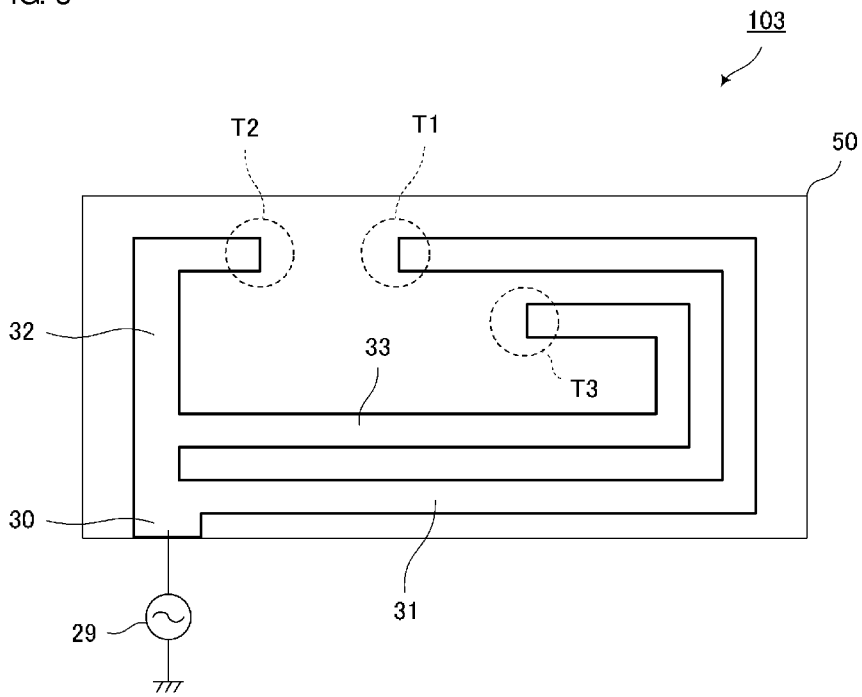
FIG. 8 is a plan view of a multi-resonant antenna 103 according to a third embodiment.

FIG. 8 is a plan view of a multi-resonant antenna 103 according to a third embodiment of the present invention. In this example, a first electrode 31 is folded back so as to have an angular U shape instead of an L shape. Moreover, a third electrode 33 is also folded back so as to have an angular U shape along the inner side of the first electrode 31. An open end T3 of this third electrode 33 is closer to an open end T1 of the first electrode 31 than to an open end T2 of the second electrode 32.

Even when the open end of the third electrode 33 is folded back in a direction approaching the feeding portion 30 in this manner, three resonance characteristics can be obtained due to the above-described effects.

Figure 9:
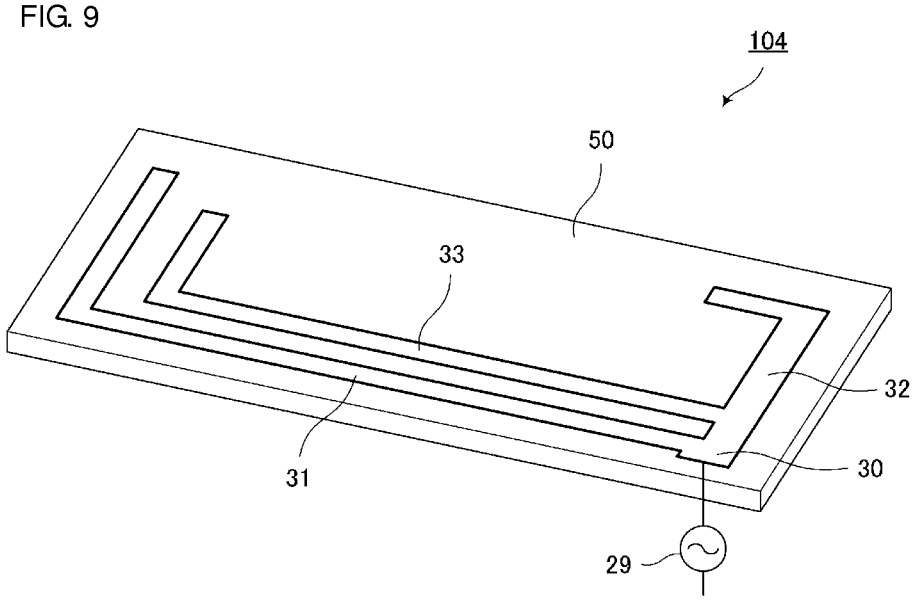
FIG. 9 is a perspective view of a multi-resonant antenna 104 according to a fourth embodiment.

FIG. 9 is a perspective view of a multi-resonant antenna 104 according to a fourth embodiment. The pattern of a first electrode 31, a second electrode 32, and a third electrode 33 included in this multi-resonant antenna 104 is mirror-symmetrical to that of the electrodes included in the multi-resonant antenna 101 shown in FIG. 3. As a matter of course, the same characteristics as in the first embodiment can also be obtained with this structure.

Although the electrodes are formed on the top surface of the dielectric substrate having a rectangular plate shape in the above-described embodiments, the present invention is not limited to this, and the electrodes can be formed in a substantially rectangular area serving as a part of a circuit board having a predetermined circuit formed thereon. In addition, the first, second, and third electrodes can be integrated into a part of a casing of an electronic device such as a mobile phone unit.

While preferred embodiments of the invention have been described above, it is to be understood that variations and modifications will be apparent to those skilled in the art without departing from the scope and spirit of the invention. The scope of the invention, therefore, is to be determined solely by the following claims.

What is claimed is:

1. A multi-resonant antenna comprising:

a substrate having a substantially rectangular area;

a feeding portion formed on said substrate;

a first electrode including an open end and a length corresponding to a first operating frequency band, said first electrode extending from the feeding portion in a first direction along a periphery of the substantially rectangular area;

a second electrode including an open end and a length corresponding to a second operating frequency band, the second frequency band being higher than the first frequency band, and the second electrode extending from the feeding portion in a second direction opposite to the first direction along the periphery of the substantially rectangular area; and a third electrode including an open end and a length corresponding to a third operating frequency band, the third frequency band being intermediate between the first and second frequency bands, and the third electrode extending from one of a predetermined point of the first electrode, a predetermined point of the second electrode, and the feeding portion, along the first electrode inside the substantially rectangular area surrounded by the first and second electrodes, the open end of the third electrode being closer to the open end of the first electrode than to the open end of the second electrode.

2. The multi-resonant antenna according to claim 1, wherein the open end of the third electrode is closer to the open end of the first electrode than to a midsection in the longitudinal direction of the first electrode when viewed from the feeding portion.

3. The multi-resonant antenna according to claim 1, wherein the third electrode is disposed or nested inside the first and second electrodes so as to be adjacent to the first electrode, and wherein the first electrode is longer than the second electrode.

4. The multi-resonant antenna according to claim 1, wherein the length of the first electrode corresponds to a 900 MHz frequency band, the length of the second electrode corresponds to a 2,100 MHz frequency band, and the length of the third electrode corresponds to a 1,600 MHz frequency band.

5. The multi-resonant antenna according to claim 1, wherein each of the first, second and third electrodes has an L shape.

6. The multi-resonant antenna according to claim 1, wherein each of the first and third electrodes has a U shape.

* * * * *